US008659519B2

(12) United States Patent
Abe et al.

(10) Patent No.: US 8,659,519 B2
(45) Date of Patent: Feb. 25, 2014

(54) PIXEL CIRCUIT WITH A WRITING PERIOD AND A DRIVING PERIOD, AND DRIVING METHOD THEREOF

(75) Inventors: Katsumi Abe, Kawasaki (JP); Kenji Takahashi, Yokohama (JP); Ryo Hayashi, Yokohama (JP); Hideya Kumomi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 491 days.

(21) Appl. No.: 12/548,796

(22) Filed: Aug. 27, 2009

(65) Prior Publication Data

US 2010/0053041 A1 Mar. 4, 2010

(30) Foreign Application Priority Data

Sep. 3, 2008 (JP) ..... 2008-226061

(51) Int. Cl.
*G09G 3/30* (2006.01)

(52) U.S. Cl.
USPC ..... 345/77

(58) Field of Classification Search
USPC ..... 345/76–77
See application file for complete search history.

(56) References Cited

U.S. PATENT DOCUMENTS

| | | | | |
|---|---|---|---|---|
| 6,462,723 | B1 | 10/2002 | Yamazaki et al. | 345/82 |
| 7,317,434 | B2 | 1/2008 | Lan et al. | 345/76 |
| 7,411,209 | B2 | 8/2008 | Endo et al. | 257/32 |
| 2005/0179624 | A1 | 8/2005 | Sun | 345/76 |
| 2005/0212448 | A1* | 9/2005 | Shibusawa | 315/169.3 |
| 2006/0066512 | A1* | 3/2006 | Afentakis et al. | 345/55 |
| 2006/0119548 | A1* | 6/2006 | Lan et al. | 345/76 |
| 2008/0122756 | A1* | 5/2008 | Kawasaki et al. | 345/76 |
| 2009/0021536 | A1* | 1/2009 | Abe et al. | 345/690 |
| 2009/0072232 | A1 | 3/2009 | Hayashi et al. | 257/43 |
| 2010/0275916 | A1 | 11/2010 | Masada et al. | 128/203.14 |

FOREIGN PATENT DOCUMENTS

| | | |
|---|---|---|
| JP | 2004-295131 | 10/2004 |
| JP | 2008-522246 | 6/2008 |

(Continued)

OTHER PUBLICATIONS

K. Nomura et al., "Room-temperature fabrication of transparent flexible thin-film transistors using amorphous oxide semiconductors," Nature, vol. 432, 488-492, Nov. 25, 2004.

H. Yabuta et al., "High-mobility thin-film transistor with amorphous $InGaZnO_4$ channel fabricated by room temperature rf-magnetron sputtering," Applied Physics Letters, vol. 89, 112123, Sep. 14, 2006.

(Continued)

*Primary Examiner* — Long D Pham

(74) *Attorney, Agent, or Firm* — Fitzpatrick, Cella, Harper & Scinto

(57) ABSTRACT

A pixel circuit including at least a light emitting element, and a thin film transistor that supplies to the light emitting element a first current controlling a gray scale according to luminance-current characteristics of the light emitting element, wherein the thin film transistor has a back gate electrode, at least a driving period in which the thin film transistor supplies the first current to the light emitting element, and a writing period in which a second current is written to the thin film transistor before the driving period in order to pass the first current to the thin film transistor during the driving period are included, and by changing voltages which are applied to the back gate electrode in the driving period and the writing period, current capability to a gate voltage of the thin film transistor is made to differ.

11 Claims, 8 Drawing Sheets

(56) References Cited

FOREIGN PATENT DOCUMENTS

| | | | |
|---|---|---|---|
| JP | 2008-151823 | | 7/2008 |
| JP | 2009-063607 | A | 3/2009 |
| JP | 2009-069571 | A | 4/2009 |
| TW | 200527938 | | 8/2005 |
| TW | 200615883 | | 5/2006 |
| WO | WO 2007/105778 | * | 9/2007 |

OTHER PUBLICATIONS

H. Lee et al., "Current-Scaling a-Si:H TFT Pixel-Electrode Circuit for AM-OLEDs: Electrical Properties and Stability," IEEE Transactions on Electron Devices, vol. 54, No. 9, 2403-2410, Sep. 2007.

Office Action issued Oct. 23, 2012, in counterpart Japanese Patent Application No. 2008-226061, with translation.

Office Action issued Apr. 10, 2013 in counterpart Taiwan (R.O.C.) Patent Application No. 098129399, with translation.

* cited by examiner

PIXEL CIRCUIT WITH A WRITING PERIOD AND A DRIVING PERIOD, AND DRIVING METHOD THEREOF

BACKGROUND OF THE INVENTION

1. Field of the Invention

The present invention relates to a pixel circuit using a light emitting display device element, a light emitting display device and a driving method thereof. The present invention particularly relates to a pixel circuit configured by an organic light emitting diode (Organic Light Emitting Diode, hereinafter called OLED) element and a drive circuit for supplying a current to the OLED element, a light emitting display device including the pixel circuits in a matrix form and a driving method thereof.

2. Description of the Related Art

In recent years, the research and development of OLED displays using organic light emitting diodes (OLED) as light emitting elements has been underway. In the OLED displays, an active-matrix (Active-Matrix, hereinafter called AM) type OLED display configured by pixel circuits including OLED elements and pixel circuits including circuits for driving the OLED elements is commonly used. AM type OLED displays elongate the service lives of the OLED elements, suppress power consumption, and can realize high image quality. The pixel circuit includes a thin-film transistor (Thin-Film-Transistor, hereinafter called TFT) as a component. A substrate and a TFT portion of the OLED display are mainly called a back plane.

As semiconductor materials of the TFT of the back plane for an AM type OLED display, amorphous silicone (amorphous-Si, hereinafter called a-Si), and a polysilicon (Polycrystal-Si, hereinafter called p-Si) and the like are studied. Further, a TFT (hereinafter, called AOSTFT) which uses a thin film of an anamorphous oxide semiconductor (amorphous-oxide-semiconductor, hereinafter called AOS) as a channel layer of the TFT has been newly proposed.

As AOS materials, there are cited, for example, an amorphous oxide (amorphous-In—Ga—Zn—O, hereinafter called a-IGZO) of indium (In), gallium (Ga) and zinc (Zn), and an amorphous oxide (amorphous-Zn—In—O, hereinafter called a-ZIO) of zinc (Zn) and indium (In). AOS TFT includes mobility ten times as high as or more of the TFT (hereinafter called a-Si TFT) having a-Si as a channel layer, and is considered to obtain high uniformity due to amorphousness. Accordingly, these TFTs are promising as the TFTs of the back planes for displays. Nomura et. al., Nature, vol. 432, pp. 488-492, 2004 and Yabuta et. al., APL, 89, 112123, 2006 describe TFTs using a-IGZO.

Meanwhile, the pixel circuits including functions of correcting characteristic change and variation are studied, because of characteristic change by electrical and thermal stress in an a-Si TFT and an AOS TFT, and because of characteristic variation due to grain boundary in a TFT using p-Si as a channel layer (hereinafter, called p-Si TFT). These pixel circuits are broadly divided into those based on two techniques that are a current-writing type which determines current capability of the TFT controlling the current to be supplied to OLED elements by a current provided from outside the pixel circuit, and a voltage-writing type which determines the current capability of the TFT by applying a voltage.

In a current-writing type pixel circuit, the voltage of the TFT is determined by the current which is applied, and therefore, the current which is supplied to the OLEDs can be controlled irrespective of the threshold voltage expressing the characteristic of the TFT, and the value of mobility. Meanwhile, in the voltage-writing type pixel circuit, the current of the TFT is determined by the voltage which is applied, and therefore, a current with the threshold voltage being corrected and the mobility being uncorrected is supplied to OLEDs. Therefore, a current-writing type pixel circuit can be generally said to be able to control the current to be supplied to OLEDs with higher precision.

However, in the case of a current-writing type pixel circuit, a line load on the display is charged and discharged with a current, and therefore, much time is taken for writing. Accordingly, the current-writing type pixel circuit is difficult to be applied to a large screen display, because as the display size is larger, the line load becomes larger. Therefore, as described in Lee et. al., IEEE Transaction of Electron Devices, vol. 54, 2403, 2007, application of a current-writing type pixel circuit to a large screen display by providing a unit for decreasing the current for driving the OLED elements for a pixel circuit as compared with the write current is being studied.

The pixel circuit described in Lee et. al., IEEE Transaction of Electron Devices, vol. 54. 2403, 2007 includes two capacitor elements. This pixel circuit supplies to the OELD elements a lower current as compared with that at a current write time by using the gate voltage of the driving TFT determined by the current at the time of current write decreasing by the charge pump effect if the voltage at one terminal of one capacitor element is decreased when the OLED elements are driven.

In order to realize display with high quality with an AM type OLED display, it is required to correct difference in the characteristics of the component elements such as the change with time of the voltage-luminance characteristic of the OLED elements, the characteristic variation of the TFT which is the component of the drive circuit, and the TFT characteristic change due to electrical stress. Further, especially in a large screen display, writing of current takes much time, and application of a current-writing type pixel circuit with high precision is difficult.

An object of the present invention is to provide a light emitting display device and a driving method thereof which solve the aforementioned problem by a configuration and a driving method which are simpler than the pixel circuit described in Lee et. al., IEEE Transaction of Electron Devices, vol. 54, 2403, 2007.

SUMMARY OF THE INVENTION

The present inventors have reached the present invention as a result of making earnest study in order to solve the problem.

The present invention is directed to a pixel circuit comprising a light emitting element, and a thin film transistor that supplies to the light emitting element a first current controlling a gray scale according to luminance-current characteristics of the light emitting element, wherein the thin film transistor has a back gate electrode, a driving period in which the thin film transistor supplies the first current to the light emitting element and a writing period in which a second current is written to the thin film transistor before the driving period in order to supply the first current from the thin film transistor during the driving period are set, the difference between the driving period and the writing period in voltage to be applied to the back gate electrode rendering the driving period and the writing period different from each other in a current capability determined by a gate voltage of the thin film transistor.

The second current can be larger than the first current.

In the pixel circuit, a voltage applied to the back gate electrode in the writing period can be set so that the current capability is higher than that controlled by the voltage applied to the back gate electrode in the driving period.

In the pixel circuit, a change in mobility of the thin film transistor by variation of the voltage applied to the back gate electrode can be 5% or less.

In the pixel circuit, a relationship between the voltage applied to the back gate electrode and a threshold voltage of the thin film transistor can be expressed by linear relation.

The second current from outside of the pixel circuit in the writing period can control the gray scale.

The voltage provided to the back gate electrode in the writing period can control the gray scale.

The present invention is directed to a light emitting display device, comprising; the pixel circuits arranged two-dimensionally, and a scanning unit applying a voltage to the back gate electrodes of a plurality of the pixel circuits arranged in a row direction for each row.

The present invention is directed to a camera, comprising; the light emitting display device; an image taking unit taking an image of a subject; an image signal processing unit processing a signal of an image taken in the image taking unit, wherein an image signal subjected to signal processing in the image signal processing unit is displayed in the light emitting display device.

The present invention is directed to a driving method of a pixel circuit comprising a light emitting element, and a thin film transistor that supplies to the light emitting element a first current controlling a gray scale according to luminance-current characteristics of the light emitting element, wherein the thin film transistor has a back gate electrode, a driving period in which the thin film transistor supplies the first current to the light emitting element and a writing period in which a second current is written to the thin film transistor before the driving period in order to supply the first current from the thin film transistor during the driving period are set, the difference between the driving period and the writing period in voltage to be applied to the back gate electrode rendering the driving period and the writing period different from each other in a current capability determined by a gate voltage of the thin film transistor.

The second current can be larger than the first current.

In the driving method of a pixel circuit, a voltage applied to the back gate electrode in the writing period can be set so that the current capability is higher than that controlled by the voltage applied to the back gate electrode in the driving period.

The second current from outside of the pixel circuit in the writing period can control the gray scale.

The voltage provided to the back gate electrode in the writing period can control the gray scale.

The present invention is directed to a driving method of a light emitting display device using the driving method of a pixel circuit, wherein the pixel circuits are arranged two-dimensionally, and a voltage is provided to the back gate electrodes of a plurality of the pixel circuits arranged in a row direction for each row.

According to the present invention, a light emitting display device with a large line load, for example, a large screen OLED display, which enables high quality display with a threshold voltage and mobility being corrected by writing a current from outside can be realized.

Further features of the present invention will become apparent from the following description of exemplary embodiments with reference to the attached drawings.

DESCRIPTION OF THE EMBODIMENTS

Figure 1:
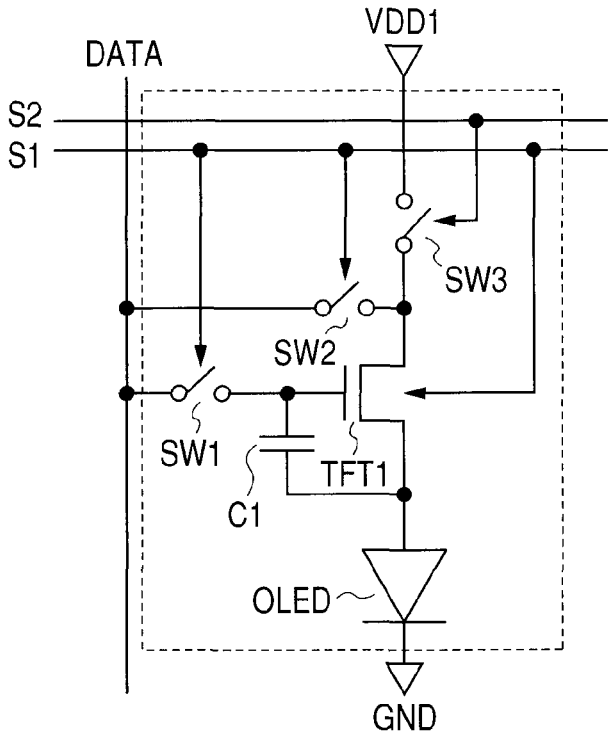
FIG. 1 is a circuit configuration diagram of a pixel circuit of embodiment 1 according to the present invention.

Hereinafter, embodiments of the present invention will be described in detail with use of the drawings.

In the embodiments which will be described hereinafter, an OLED display including a pixel circuit having AOS TFT with a-IGZO as a channel layer, and light emitting elements configured by OLED elements will be described. However, the present invention also can be applied to a light emitting display device using TFT having a semiconductor other than a-IGZO as a channel layer, and a light emitting display device using light emitting elements other than OLED elements. Further, the present invention also can be applied to an AM type device using TFT other than a light emitting display device, for example, a pressure sensor using a pressure sensitive element, and an optical sensor using a light-sensitive element, and the similar effect can be obtained. As an AOS material, an amorphous oxide (amorphous-Zn—In—O, hereinafter called a-ZIO) of zinc (Zn) and Indium (In) is cited other than a-IGZO. For the channel layer, the material including another additive material with a-IGZO or a-ZIO as a main component may be used other than the material formed from only a-IGZO or a-ZIO. Further, p-Si and a-Si other than an AOS material can be used as the channel layer of TFT.

One of the characteristics of the present invention is that the change of the current capability by voltage application to the back gate is used for reducing the current writing period. Further, by using an oxide semiconductor as the channel layer, the current capability control range by back gate voltage application can be increased to a wide range, and the current writing period can be further reduced.

"amorphous" used in the present application refers to the state in which a clear peak cannot be seen in X-ray diffraction.

The present inventors have obtained the following knowledge by proceeding with evaluation of a-IGZO TFT having a back gate electrode.

The drain current-gate voltage characteristic of a-IGZO TFT having a back gate electrode moves parallel with the gate voltage according to the voltage of the back gate electrode (hereinafter, called a back gate voltage). In other words, while the threshold voltage changes with respect to change in the back gate voltage, change in the mobility is small (5% or less). Thus, change in mobility by variation of the voltage of the back gate electrode of TFT is preferably 5% or less. The smaller the change in mobility, the better.

It should be noted that mobility shall be the mobility in the same gate voltage corrected by change amount of the threshold voltage. For example, when the threshold voltage is shifted by +1 V by changing the back gate voltage by −1 V, this means that the difference between the mobility at a gate voltage of 10 V before change and the mobility at a gate voltage of 11 V after change is 5% or less of the mobility before change. Further, in a-IGZO TFT, linear relation is established between the back gate voltage and the threshold voltage. The parallel shift is also established even when the back gate voltage is changed by +10 V from −10 V. During this while, the threshold voltage changes in a range of several voltages.

The parallel shift of the drain current-gate voltage characteristic of TFT by the back gate voltage is known in p-Si TFT, and in the case of a-IGZO TFT, the change ranges of the parallel shift of the current-voltage characteristic which can be controlled by the back gate voltage, and the threshold voltage are large. This seems to be mainly derived from difference in the band gap of the semiconductor layer used for the channel layer.

In the present invention, in the pixel circuit, in the period in which the current supplied from outside the pixel circuit is written, a voltage is applied to the back gate electrode of TFT from outside the pixel circuit, and thereby, current capability is increased. Thereafter, by applying the voltage which decreases the current capability to the back gate electrode in the driving period in which current is supplied to the OLED element, TFT supplies a current lower than the written current, and drives the OLED element.

Accordingly, the current supplied from outside in the period in which current is written can be made the current which can charge and discharge the line load of the display, and the pixel circuit can be applied to a display with a large line load such as a large screen display. Further, the current from outside the pixel circuit is written. Therefore, the threshold voltage and mobility of TFT in the pixel circuit are both correctible. Since the current is supplied to the OLED element, the threshold voltage of the OLED element is also correctible, and therefore, the image quality with high precision can be realized.

Further, in the present invention, the current which is supplied from outside in the period in which current is written is made a constant current. Therefore, the amount of charge and discharge of line load of the display can be decreased. Further, the back gate voltage of TFT is controlled by writing of the voltage from outside the pixel circuit, and thereby, the current which is supplied to the OLED element can be controlled. Controlling the back gate voltage from outside the pixel circuit is writing by a voltage, and therefore, can be made in a short write time. Accordingly, the pixel circuit can be applied to a display with a large line load such as a large screen OLED display. Further, since the current from outside the pixel circuit is written, the threshold voltage and mobility of TFT of the pixel circuit can be both corrected. Since the current is supplied to the OLED element, the threshold voltage of the OLED element can be corrected, and therefore, image quality with high precision can be realized.

By using a-IGZO TFT as TFT, the current capability of TFT, that is, the threshold voltage can be controlled in a large back gate voltage range. Accordingly, the current supplied from outside the pixel circuit in the current writing period, or a constant current can be made large as compared with other TFTs. Therefore, the time required for charge and discharge of the line load of a display can be reduced, and the pixel circuit can be applied to a high definition display with a large screen.

Embodiment 1

First, the characteristics of a TFT having a back gate electrode and has a-IGZO as a channel layer, which is used in the present embodiment, will be described.

Figure 3:
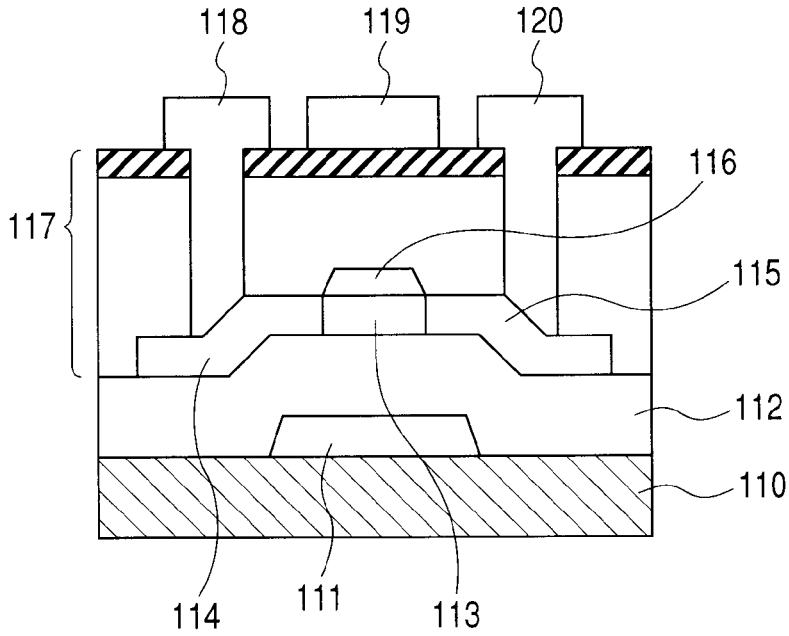
FIG. 3 is a sectional view illustrating the structure of a-IGZO TFT used in the pixel circuit according to the present invention.

FIG. 3 is a sectional view of TFT having a back gate electrode and a-IGZO as a channel layer.

A production method of a-IGZO TFT having a structure illustrated in FIG. 3 will be described hereinafter.

A Mo film (100 nm thick) is deposited on a glass substrate 110 which is an insulating substrate by a sputtering deposition method, and by a photolithography method and dry etching, a gate electrode 111 is formed.

Thereafter, by a plasma CVD deposition method, an SiO film (200 nm thick) is deposited, and a gate insulating layer 112 is formed.

Thereafter, at a room temperature, by a sputtering deposition method, an a-IGZO film (30 nm thick) is deposited, and is islanded by a photolithography method and wet etching. The a-IGZO film functions as part of a channel region (channel layer) 113 and a source and drain regions 114 and 115 of the TFT.

Thereafter, by a sputtering deposition method, an SiO film (100 nm thick) is deposited as a channel protection film 116, and a channel pattern is formed by a photolithography method and a dry etching method.

Thereafter, by a plasma CVD deposition method, an SiN film (300 nm thick) and an SiO film (50 nm thick) are sequentially stacked as an interlayer insulating film 117 to deposit an SiO/SiN stacked film. Further, by a photolithography method and a dry etching method, contact holes for source/drain electrodes, and a contact hole for the gate electrode are formed. The region of the a-IGZO film which is not covered with the sputter SiO film has a low resistance at the time of SiN film deposition to be a source/drain region.

Thereafter, by a sputtering deposition method, an Mo film (200 nm thick) is deposited, and by a photolithography method and a dry etching method, source/drain electrodes 118 and 120, and a back gate electrode 119 are formed. Thus, the TFT illustrated in FIG. 3 is formed.

The electric characteristics of the a-IGZO TFT obtained by the aforementioned production method will be shown.

Figure 4:
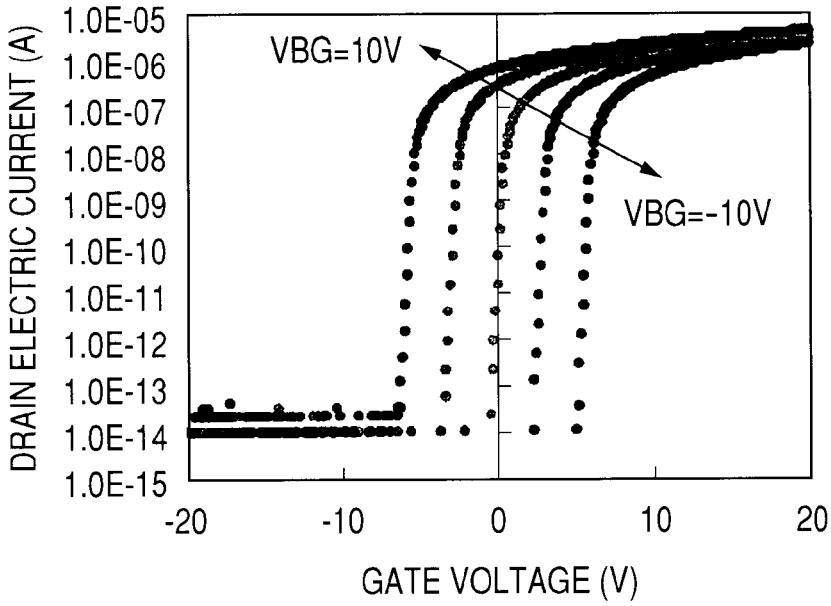
FIG. 4 is a characteristic chart illustrating an Id-Vg characteristic of a-IGZO TFT used in the pixel circuit according to the present invention and its back gate voltage dependency.

FIG. 4 illustrates drain current ID-gate voltage VG characteristics (hereinafter, called an ID-VG characteristics) in the case of a drain voltage VD of 0.1 V, a source voltage VS of 0 V and back gate voltages VBG of −10, −5, 0, 5 and 10 V of a-IGZO TFT. A channel width (hereinafter, called W) of a-IGZO TFT is 60 μm, and a channel length (hereinafter, called L) is 10 μm.

FIG. 4 illustrates that the lower the back gate voltage VBG is, the ID-VG characteristic moves parallel to a positive side with respective to the gate voltage. In FIG. 4, for example, 1.0E-5 means $1.0\times10^{-5}$.

Figure 5:
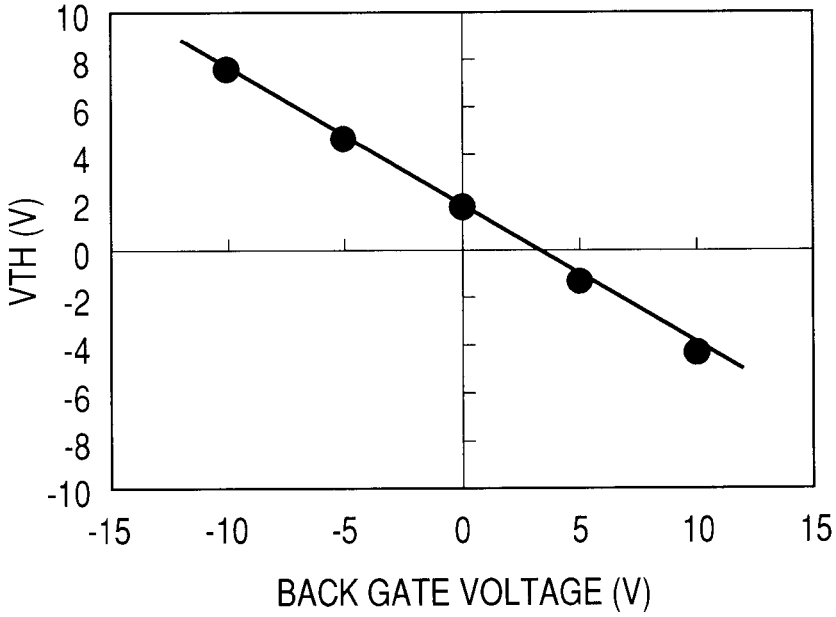
FIG. 5 is a characteristic chart illustrating back gate voltage dependency of a threshold voltage of a-IGZO TFT used in the pixel circuit according to the present invention.
Figure 6:
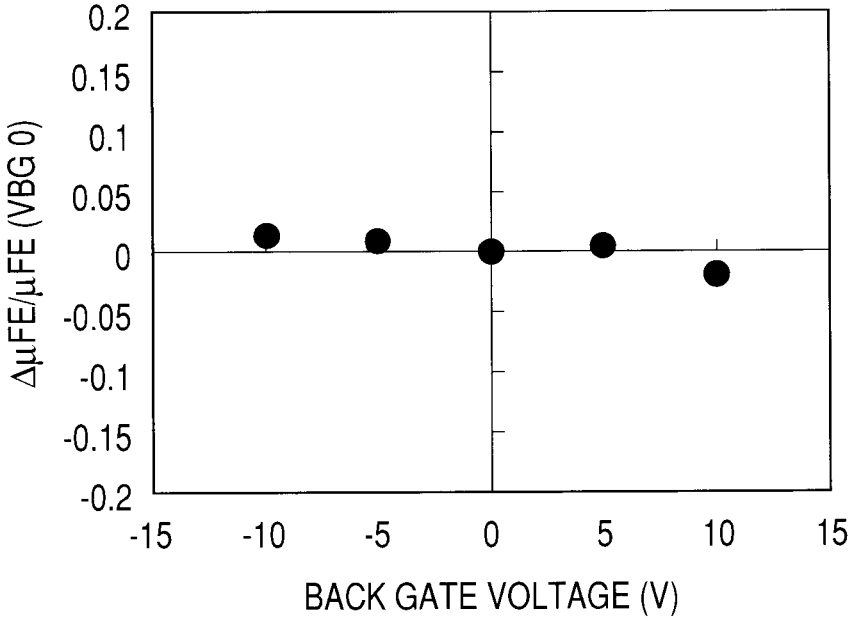
FIG. 6 is a characteristic chart illustrating a change rate of the field effect mobility of a-IGZO TFT with respect to a back gate voltage.

FIG. 5 illustrates dependency of a threshold voltage VTH with respect to the back gate voltage VBG, which is obtained from these ID-VG characteristics. FIG. 6 illustrates the change rate with respect to the value of a field effect mobility μFE at VBG=0. From FIG. 5, the relationship of the back gate voltage VBG and the threshold voltage VTH is expressed by the linear relation, and when the relation is $$VTH=VTH0-a\times VBG \quad \text{formula (1),}$$

wherein VTH0 represents the threshold voltage at the back gate voltage VBG of 0 V; and, a=CBG/CG wherein CG represents a capacitance per unit area of the gate insulating film, and is $1.86\times10^{-8}$ (F/cm$^2$), and GBG represents a capacitance per unit area of the insulating film existing between the back gate electrode and a-IGZO, and is $1.08\times10^{-8}$ (F/cm$^2$). The obtained measurement result can be reproduced. Further, from FIG. 6, change in mobility with respect to the back gate voltage variation is 3% or less and the mobility does not depend on the back gate voltage, and is considered to be substantially constant.

Thereby, a drain current ID, in the linear region of TFT, can be expressed as $$ID=\beta\times[(VG-VTH)\times VD-0.5\times VD^2] \quad \text{formula (2),}$$

and in the saturation region, the drain current ID can be expressed as $$ID=0.5\times\beta\times(VG-VTH)^2 \quad \text{formula (3),}$$

wherein β=μFE×CG×(W/L)

Figure 15:
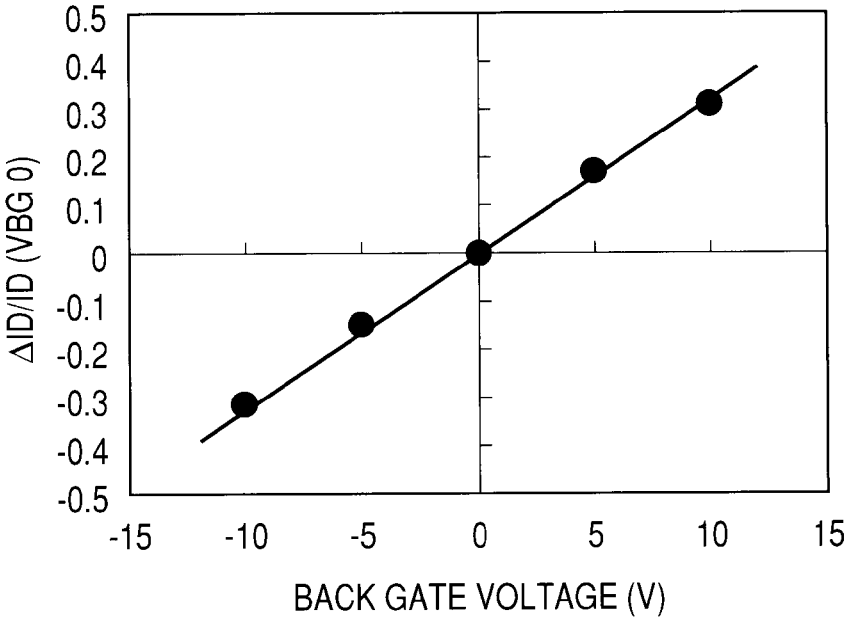
FIG. 15 is a characteristic chart illustrating the relationship of back gate voltage dependency and variation of a drain current (ΔID/ID).

As illustrated in FIG. 15, the back gate voltage dependency (straight line) with respect to the drain current at VBG=0 calculated from formula (2) in VG=20 V and VD=0.1 V reproduces the actual measurement result (point). Like this, in a-IGZO TFT, the relation of the back gate voltage and the threshold voltage change is linear, and therefore, the drain current including the influence of the back gate voltage can be expressed by the simple formula. Therefore, design is facilitated by using this TFT.

The pixel circuit of the OLED display of the present embodiment is illustrated in FIG. 1. In the present embodiment, the pixel circuit is configured by an OLED element (OLED), one a-IGZO TFT (TFT 1), three switches SW1, SW2 and SW3, and a capacitor C1 existing between a gate and a source of the TFT 1. The OLED element (OLED) is a light emitting element, and the TFT 1 is a thin film transistor which supplies to the OLED a current (first current) for controlling a gray scale in accordance with the light emitting luminance-current characteristic of the OLED. The TFT 1 is a drive TFT which controls the current to be supplied to the organic EL element (OLED), and has a back gate electrode.

Signals which control ON/OFF of the switch SW1, ON/OFF of the switch SW2 and the back gate voltage of the TFT 1 are applied to a scanning line S1. A signal which controls ON/OFF of the switch SW3 is applied to a scanning line S2. A power supply line VDD1 is connected to the switch SW3. A data line DATA is connected to the switch SW1, and supplies a current to the gate of the TFT 1 and the capacitor C1 via the switch SW1.

Figure 2:
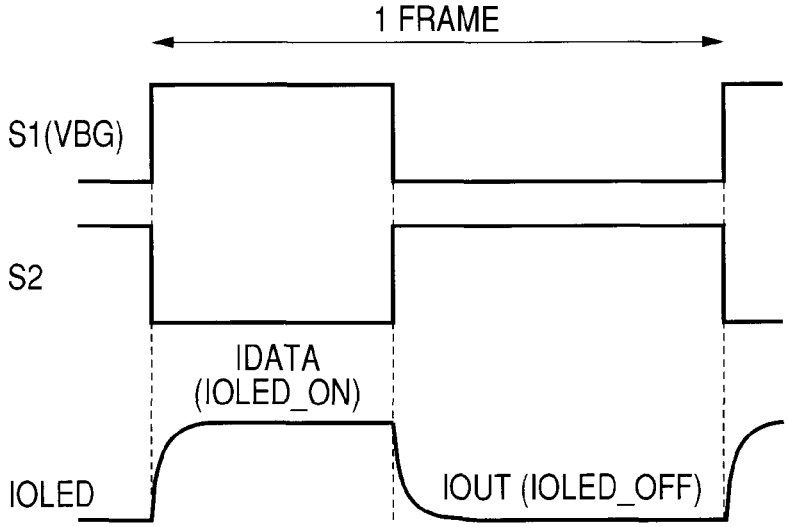
FIG. 2 is a timing chart illustrating an operation of the pixel circuit of embodiment 1.

An operation of the present embodiment will be described by dividing one frame into two periods that are a current writing period and a driving period. FIG. 2 illustrates a timing chart of the operation.

(a) Current Writing Period

In the current writing period, a current IDATA (to be a second current) supplied from outside the pixel circuit is written to the TFT 1 through the data line DATA. The current writing period takes place before the driving period.

In the current writing period, the voltage of the scanning line S1 is set to an H level (VH), whereas the voltage of the scanning line S2 is set to an L level (VL). Accordingly, the switches SW1 and SW2 are in an electrically continuing (ON) state, and the switch SW3 is in a discontinuing (OFF) state. Further, the back gate voltage of the TFT 1 becomes VH, and the current capability is in a high state.

At this time, the current IDATA flows in the TFT 1, and is supplied to the OLED element (OLED). The gate voltage of the TFT 1 is set at the voltage for passing the current IDATA in accordance with the current-voltage characteristic of the TFT 1, that is, the threshold voltage and mobility. The drain and gate of the TFT 1 is short-circuited, and therefore, the TFT 1 operates in the saturation region. Accordingly, from formula (3), the current IDATA and the voltage of each terminal of the TFT 1 are expressed by the following relational expression.

$$IDATA=0.5\times\beta\times[(VG-VS)-\{VTH0-a\times(VH-VS)\}]^2 \quad \text{formula (4),}$$

wherein VG represents a gate voltage, VS represents a source voltage, μFE represents the aforementioned mobility, VTH0 represents the threshold voltage at VBG=0, CG represents a gate insulating film capacitance, and CBG is a capacitor at the back gate side.

(b) Driving Period

In the driving period, the OLED element is driven by supplying to the OLED element the current controlled based on the current IDATA supplied from the data line DATA.

In the driving period, the voltage of the scanning line S1 is set to an L level (VL), and the voltage of the scanning line S2 is set to an H level (VH). Accordingly, the switches SW1 and SW2 are in a discontinuing (OFF) state, and the switch SW3 is in a continuing (ON) state. Further, the back gate voltage of the TFT 1 becomes VL, and is in a state in which the current capability is lower than in the current writing period.

Since the switches SW1 and SW2 are in the OFF state, the voltage difference between the gate and source which is set in the current writing period is held, and a current IOUT for driving the OLED element is expressed by the following formula.

$$IOUT=0.5\times\beta\times[(VG-VS)-\{VTH0-a\times(VL-VS')\}]^2\approx[(IDATA)^{1/2}-a\times(0.5\times\beta)^{1/2}\times(VH-VL)]^2 \quad \text{formula (5),}$$

wherein VS' represents a source voltage in the driving period, and the approximation sign (≈) at the lower stage of formula (5) means omission of the difference of the back gate voltage and the source voltage.

In the right side of formula (5), the threshold voltage does not clearly appear. Accordingly, even if the threshold voltages of the TFTs 1 differ among a plurality of pixel circuits for some cause, the respective currents IOUT are uniform. Meanwhile, concerning mobility, the right side of formula (5) includes β(=μFE×CG×(W/L)), and when the mobility differs, the current IOUT differs. However, since the first term $(IDATA)^{1/2}$ in the large parenthesis [ ] is not influenced even when the mobility differs, change in the current IOUT is small as compared with the case where the mobility simply differs, and change and variation of the mobility can be corrected.

As a result that the influence of the change and variation of the mobility is studied by using formula (5), when the IOUT is set to be ½ of the IDATA, if the change or the variation of the mobility is 5% or less, the variation of the IOUT becomes 2% or less. 2% corresponds to the precision of the 64 display gray scales (1.64≈1.6%), and therefore, in order to satisfy the gray scale in the adjacent pixels, change or variation of the mobility is desirably 5% or less. The a-IGZO TFT in the present embodiment can realize the current precision of the 64 gray scales since the mobility change by the back gate voltage is 3% or less.

In the present embodiment, control of the luminance of the OLED element corresponding to the gray scale of one frame period, that is, control of the current which is supplied to the OLED element can be performed by controlling the IDATA. The average current IAVG to be supplied to the OLED element, which determines the luminance of the one frame period is expressed by the following formula.

$$IAVG=[(IDATA\times t1+IOUT\times t2)/(t1+t2)] \quad \text{formula (6),}$$

wherein t1 represents a length (time) of the current writing period, and t2 represents a length (time) of the current writing period. Further, IOUT also can be controlled by the values of VH, VL and "a" in formula (5).

By carrying out the above operation, the AM type OLED display including the pixel circuits of the present embodiment in the matrix form can correct change and variation of the characteristics (threshold voltage, mobility) of the a-IGZO TFT, and can perform display with high quality. The display of the present embodiment can be applied to a large screen display especially by increasing the IDATA to such an extent that the line load of the display can be charged and discharged during the writing period.

Further, in the present embodiment, the number of required capacitors is smaller by one as compared with the pixel circuit of IEEE Transaction of Electron Devices, vol. 54, 2403, 2007, and the coupling effect of the capacitors is not used. Accordingly, it is conceivable that the pixel circuit having a small area and strong against noise can be realized.

Further, the switches SW1, SW2 and SW3 of the present embodiment can be configured by the a-IGZO TFT. Since the a-IGZO TFT has a small off current and S value, high charge retention capability and high-speed switching are compatible. Thus, the a-IGZO TFT is suitable for a switch. In embodiments which will be described later, the switches can be configured by the a-IGZO TFTs.

Further, the relationship of arrangement of the back gate electrode and the gate electrode of the TFT of the present embodiment is established even if they are replaced with each other. In the present embodiment, the TFT is treated as an a-IGZO TFT of a bottom gate structure, but if the back gate electrode is treated as a top gate, the TFT also can be treated as the TFT of the top gate structure. What should be given attention is a ratio a=CBG/CG of the capacitor CG per unit area of the gate insulating film and the capacitor CBG per unit area of the insulating film between the channel and back gate electrode. When what is considered as the bottom gate structure is considered as the top gate structure, the ratio becomes 1/a. If CG and CBG are the same, the same result is obtained even if either is treated as the gate or the back gate.

The relationship of arrangement of the back gate electrode and the gate electrode is the same in the embodiments which will be described later.

Further, in the present embodiment, the scanning line S1 is connected to the back gate voltage, but the signal line may be additionally prepared for the back gate voltage. In this case, the layout area of the pixel slightly increases, but the advantage of the degree of freedom of control becoming large is provided.

Further, in the present embodiment, the relation of the back gate voltage of the a-IGZO TFT and the threshold voltage is expressed by the linear relation, but the linear relation is not the requirement of the present embodiments and the present invention. To any relation, the present embodiment can be applied as long as the drain current-gate voltage characteristic of the TFT with respect to the back gate voltage is parallel shift with respect to the gate voltage. However, formula (1) to formula (5) need to be corrected. For example, if the threshold voltages of the TFT when the back gate voltages are VH and VL are VTH1=VTH0+V1, and VTH2=VTH0+V2, formula (5) is expressed as follows.

$$IOUT=0.5\times\beta\times[(VG-VS)-(VTH0+V2-VS')]^2\approx[(IDATA)^{1/2}+(0.5\times\beta)^{1/2}\times(V1-V2)]^2$$

The conditions of parallel shift are the same as those in the embodiments that will be described later.

Figure 13:
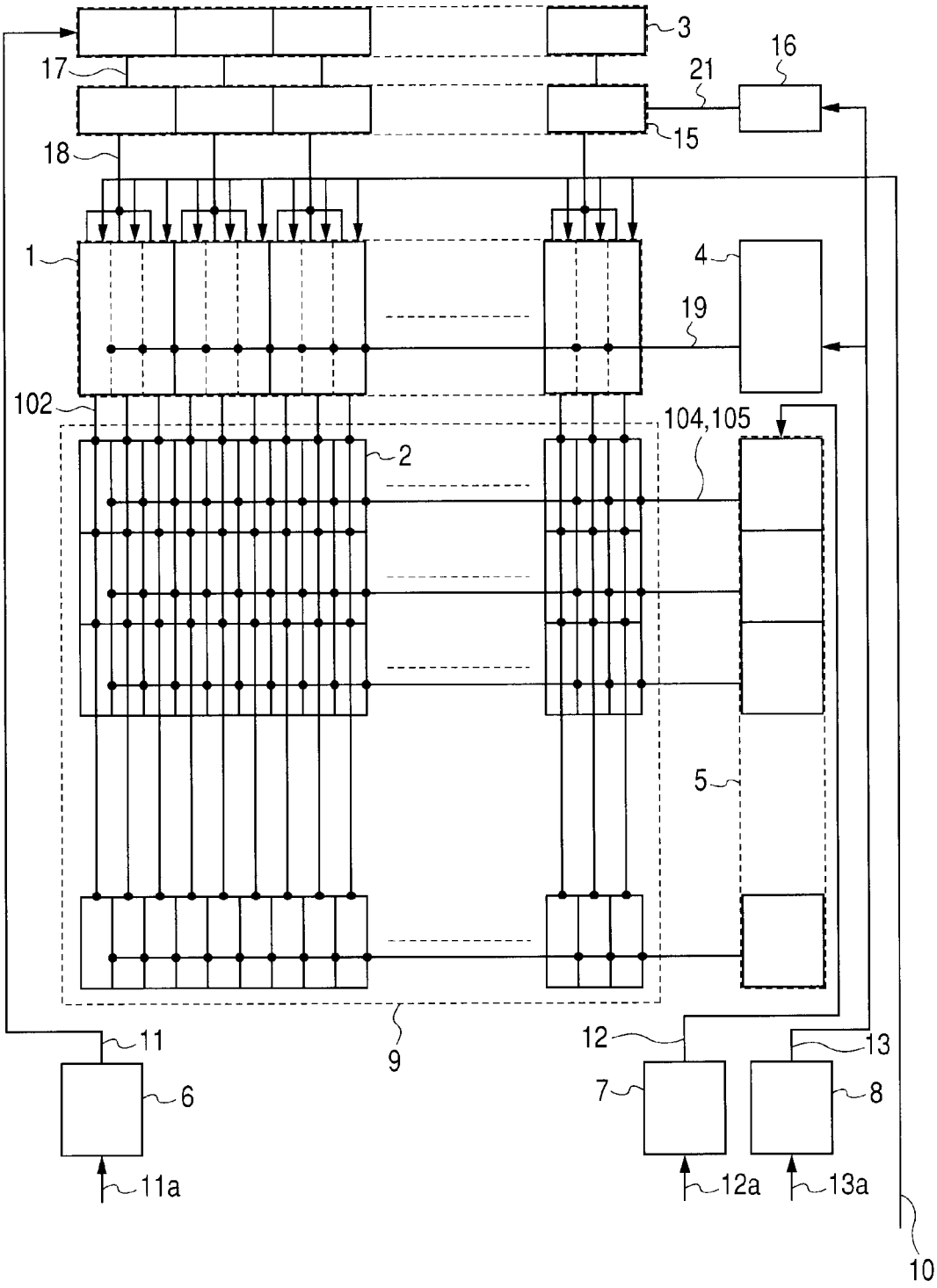
FIG. 13 is a circuit configuration diagram illustrating a circuit configuration of an entire OLED display in which respective pixel circuits are arranged two-dimensionally.

Next, FIG. 13 illustrates an entire circuit configuration of the OLED display in which the above described pixel circuits are arranged two-dimensionally. Input image signals 10 of R (red), G (green) and B (blue) (hereinafter, called input image signals) are input into column control circuits 1 of which number is three times as large as the number of horizontal pixels of the OLED display. Thereafter, a horizontal control signal 11*a* is input in an input circuit 6, a horizontal control signal 11 is output, and is input in the horizontal shift register 3.

An auxiliary column control signal 13*a* output as an auxiliary column control signal 13 through an input circuit 8 and the auxiliary control signal 13 is input in gate circuits 4 and 16. A horizontal sampling signal group 17 output to an output terminal corresponding to each column of a horizontal shift register 3 is input into a gate circuit 15 to which a control signal 21 output from the gate circuit 16 is input, and a horizontal sampling signal group 18 which is converted in the gate circuit 15 is input into the column control circuit 1. A control signal 19 output from the gate circuit 4 is input into the column control circuit 1. A vertical control signal 12*a* is input in an input circuit 7, and a vertical control signal 12 is output and is input in the vertical shift register 5. The scanning signal is input in row control lines 104 and 105 which become scanning lines.

A data signal, which is corresponding to IDATA in this embodiment, from the column control circuit 1 is input in each pixel circuit 2 of a display region 9 through a data line 102.

A plurality of aforementioned pixel circuits arranged in the row direction are scanned for each row by a vertical shift register (to be a scanning unit) 5, and electric signals for writing a current are provided to a plurality of pixel circuits arranged in the column direction for each column by the column control circuit 1. The vertical shift register 5 is a scanning unit for applying a voltage to back gate electrodes for each row.

In the OLED display having the pixel circuit of each of the embodiments which will be described later, the configuration of the aforementioned OLED display can be used.

Embodiment 2

Figure 7:
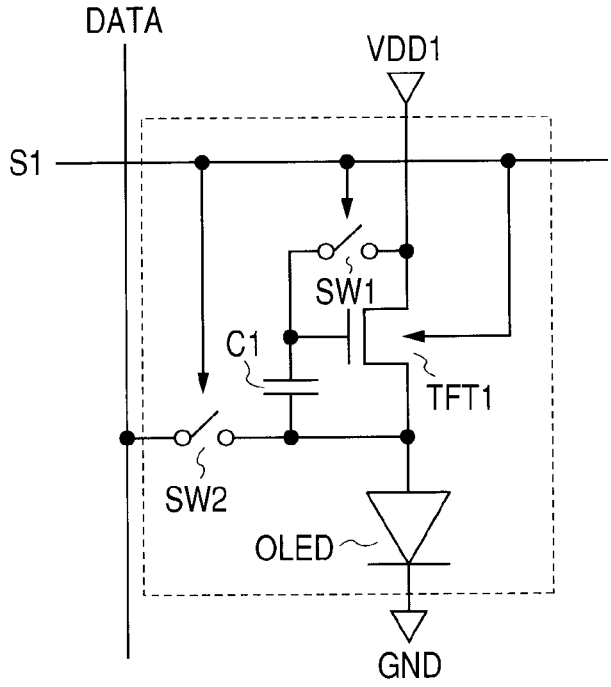
FIG. 7 is a circuit configuration diagram of a pixel circuit of embodiment 2 according to the present invention.

FIG. 7 illustrates a pixel circuit of an OLED display of embodiment 2. As illustrated in FIG. 7, in this embodiment, the switch SW3 and the scanning line S2 are removed from embodiment 1, connection of the switch SW1 is changed to between the gate and drain of the TFT 1, and connection of the switch SW2 is switched to between the source and data lines of the TFT 1.

An operation thereof will be described hereinafter.

(a) Current Writing Period

In the current writing period, a current (IDATA) supplied from outside the pixel circuit through the data line DATA is written to the TFT 1.

In the current writing period, the voltage of the scanning line S1 is set to an H level (VH). Accordingly, the switches SW1 and SW2 are in an electrically continuing (ON) state. Further, the back gate voltage of the TFT 1 becomes VH, and the current capability is in a high state. Further, the level of the power supply line VDD 1 is set to be the threshold voltage of the OLED element or less.

At this time, the IDATA flows in the TFT 1 without flowing in the OLED element. The gate voltage of the TFT 1 is set at the voltage for passing the IDATA according to the current-voltage characteristics of the TFT 1, that is, the threshold voltage and mobility. Since the drain and gate of the TFT 1 is short-circuited, the TFT 1 operates in the saturation region, and the IDATA is expressed by the following formula (4).

(b) Driving Period

In the driving period, the OLED element is driven by supplying to the OLED element the current controlled based on the IDATA supplied from the data line DATA.

In the driving period, the voltage of the scanning line S is set to an L level (VL). Accordingly, the switches SW1 and SW2 are brought into a discontinuing (OFF) state. Further, the back gate voltage of the TFT 1 becomes VL, and is in a state in which the current capability is low. Further, the level of the power supply line VDD1 is set at a voltage sufficiently higher than the sum of the threshold voltage of the OLED element and the threshold voltage of the TFT 1.

Since the switches SW1 and SW2 are in the OFF state, the gate voltage which is set in the current writing period is held, and a current IOUT for driving the OLED element is expressed by formula (5) as in embodiment 1.

Further, control of the luminance of the OLED element corresponding to the display gray scale of one frame period, that is, control of the current which is supplied to the OLED element can be performed by controlling the current IDATA. The average current in one frame to be supplied to the OLED element, which determines the luminance, is expressed by the following formula, because a current is not supplied to the OLED element at the current writing time.

$$IAVG=[(IOUT\times t2)/(t1+t2)] \quad \text{formula (7)}$$

Further, the IOUT can be controlled by the values of VH, VL and a from formula (5).

By carrying out the above operation, the AM type OLED display including the pixel circuits of the present embodiment in the matrix form can correct change and variation of the characteristics (threshold voltage, mobility) of the a-IGZO TFT, and can perform display with high quality. The display of the present embodiment can be applied to a large screen display especially by increasing the IDATA to such an extent that the line load of the display can be charged and discharged during the writing period. Further, the present embodiment can decrease the components of the pixel circuit by varying the voltage of the power supply line VDD1, and can be realized with a smaller area.

Further, in the present embodiment, the scanning line S1 is connected to the back gate voltage, but the signal line may be additionally prepared for the back gate voltage. In this case, the layout area of the pixels slightly increases, but the advantage of increasing the degree of freedom is provided.

Embodiment 3

Figure 8:
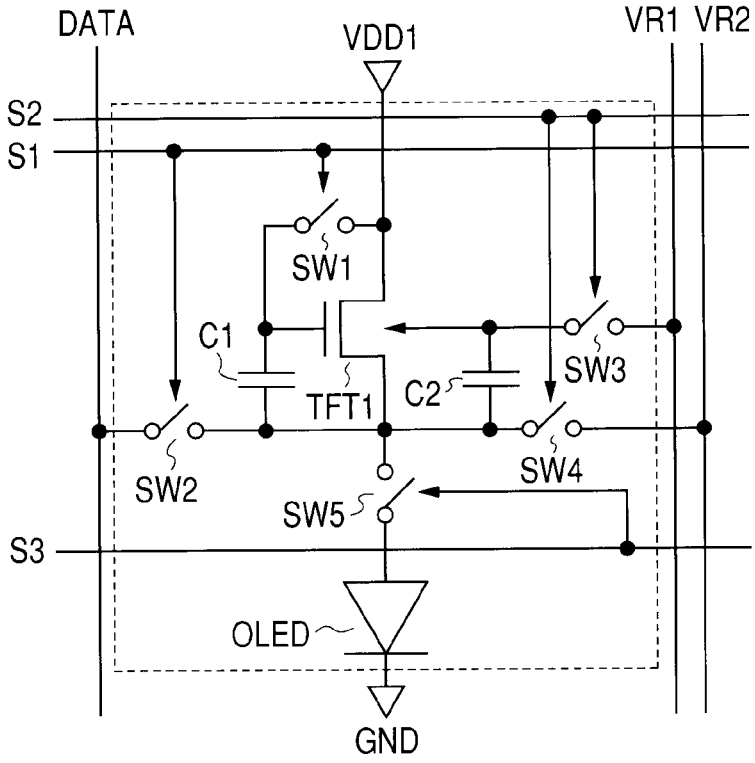
FIG. 8 is a circuit configuration diagram of a pixel circuit of embodiment 3 according to the present invention.

A pixel circuit of an OLED display of embodiment 3 is illustrated in FIG. 8. The characteristic of the present embodiment is that the voltage change between the back gate and source omitted in embodiments 1 and 2 are made correctable. Thereby, change and variation of the threshold voltage of the OLED element can be corrected.

As illustrated in FIG. 8, in this embodiment, a capacitor C2, the switch SW3, a switch SW4, a switch SW5, a scanning line S2, a scanning line S3, a reference voltage line VR1 and a reference voltage line VR2 are added as compared with the configuration of embodiment 2 illustrated in FIG. 7. The capacitor C2 is disposed between the back gate and source of the TFT 1. The switch SW3 is disposed between the back gate of the TFT 1 and the reference voltage line VR1, the switch SW4 is disposed between the source of the TFT1 and the reference voltage line VR2, and the switch SW5 is disposed between the source of the TFT 1 and the anode of the OLED. The scanning line S2 controls ON/OFF of the switches SW3 and SW4, whereas the scanning line S3 controls ON/OFF of the switch SW5.

Figure 9:
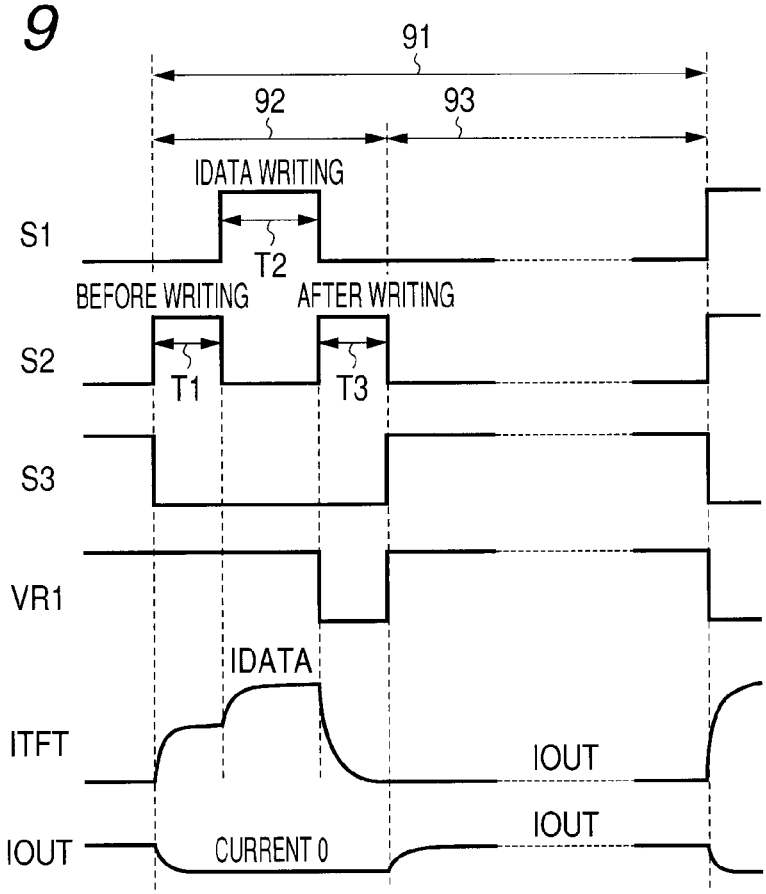
FIG. 9 is a timing chart illustrating an operation of the pixel circuit of embodiment 3.

A timing chart of the present embodiment is illustrated in FIG. 9, and an operation of it will be described hereinafter.

(a) Current Setting Period 92

In the present embodiment, a back gate voltage writing period is included before and after the current writing period of embodiments 1 and 2, and in these three periods, the current which is supplied to the OLED element is set.

(a-1) Back Gate Voltage Writing Period T1

In a back gate voltage writing period T1, the voltage between the back gate and source in the current writing period is set.

In the back gate voltage writing period T1, the voltage of the scanning line S2 is set at an H level (VH'), and the voltages of the scanning lines S1 and S3 are set at an L level (VL'). Accordingly, the switches SW3 and SW4 are in an ON state, whereas the switches SW1, SW2 and SW5 are in an OFF state.

In the above case, when the voltage of the reference voltage line VR1 is set at an H level (VH), and the voltage of the reference voltage line VR2 is set at 0 V, the voltage VH is applied to the capacitor C2.

(a-2) Current Writing Period T2

In a current writing period T2, the current (IDATA) which is supplied from outside the pixel circuit through the data line DATA is written to the TFT 1.

In the current writing period T2, the voltage of the scanning line S1 is set at an H level (VH'), and the voltages of the scanning lines S2 and S3 are set at an L level (VL'). Accordingly, the switches SW1 and SW2 are in an ON state, and the switches SW3, SW4 and SW5 are in an OFF state. At this time, the voltage difference VH between the back gate and source which is set in the back gate voltage writing period T1 is held by the capacitor C2, and the current capability is in a high state.

The current IDATA flows in the TFT 1 without flowing in the OLED element since the switch SW5 is OFF. The gate voltage of the TFT 1 is set at the voltage for passing the current IDATA according to the current-voltage characteristics of the TFT 1, that is, the threshold voltage and mobility. The drain and gate of the TFT 1 is short-circuited, and therefore, the TFT 1 operates in the saturation region. Accordingly, the current IDATA is expressed by the following formula.

$$IDATA=0.5\times\beta\times[(VG-VS)-\{VTH0-a\times VH\}]^2 \quad \text{formula (4')}$$

(a-3) Back Gate Voltage Writing Period T3

In a back gate voltage writing period T3, the back gate voltage of the TFT 1 is changed to the L level from the H level.

In the back gate voltage writing period T3, the voltage of the scanning line S2 is set at the H level (VH'), and the voltages of the scanning lines S1 and S3 are set at the L level (VL'). Accordingly, the switches SW3 and SW4 are in an ON state, and the switches SW1, SW2 and SW5 are in an OFF state. Further, the voltage of the reference voltage line VR1 is set at the L level (VL), and the voltage of the reference voltage line VR2 is kept at 0 V.

At this time, the voltage difference between the back gate and source becomes VL while the voltage difference between the gate and source of the TFT1 at the current writing time is being held.

(b) Driving Period 93

In a driving period 93, the OLED element is driven by supplying the current which is controlled based on the IDATA supplied from the data line to the OLED element.

In the driving period, the voltage of the scanning line S3 is set at the H level (VH'), and the voltages of the scanning lines S1 and S2 are set at the L level (VL'). Accordingly, the switch SW5 is in an ON state, and the switches SW1, SW2, SW3 and SW4 are in an OFF state. At this time, the voltage difference between the back gate and source is held at VL by the capacitor C2, and the current capability is in a low state.

By the operation in the above described current setting period 92 (the back gate voltage writing period T1–the back gate voltage writing period T3), the current IOUT in the present period is expressed as $$IOUT=0.5\times\beta\times[(VG-VS)-\{VTH0-a\times VL\}]^2=[(IDATA)^{1/2}-a\times(0.5\times\beta)^{1/2}\times(VH-VL)]^2 \quad \text{formula (5')}$$

In the present embodiment, by using the capacitor C2, the switches SW3 and SW4, and the reference voltage lines VR1 and VR2, the voltage difference between the back gate and source is determined. Accordingly, in the lower stage of formula (5'), the equal sign (=) is used instead of the approximation sign (≈).

Further, control of the luminance of the OLED element corresponding to the display gray scale of one frame period 91, that is, control of the current which is supplied to the OLED element can be performed by controlling the current IDATA. The average current in one frame period which is supplied to the OLED element which determines luminance is expressed by the formula (7) since a current is not supplied to the OLED element at the current writing time. However, in the present embodiment, t1 is set as the length (time) of the current setting period instead of the current writing period. The IOUT also can be controlled by the current setting time, and further by the values of VH, VL and a from formula (5').

By carrying out the above operation, the AM type OLED display including the pixel circuits of the present embodiment in the matrix form can correct change and variation of the characteristics (threshold voltage, mobility) of a-IGZO TFT, and can perform display with high quality. The display of the present embodiment can be applied to a large screen display especially by increasing the IDATA to such an extent that the line load of the display can be charged and discharged during the writing period. Further, the present embodiment holds the voltage between the back gate and source, and therefore, can correct not only the change and variation of the characteristics of the TFT, but also change and variation of the characteristics of the OLED elements.

Further, in the present embodiment, the reference voltage line VR2 is additionally prepared for setting the back gate voltage, but it can be replaced by the scanning line S3 which is at a constant voltage in the current setting period. Likewise, in the present embodiment, the scanning line S3 and the switch SW5 are prepared for the current writing period, but they can be omitted by driving the pixel circuits as in embodiment 2.

Embodiment 4

Figure 10:
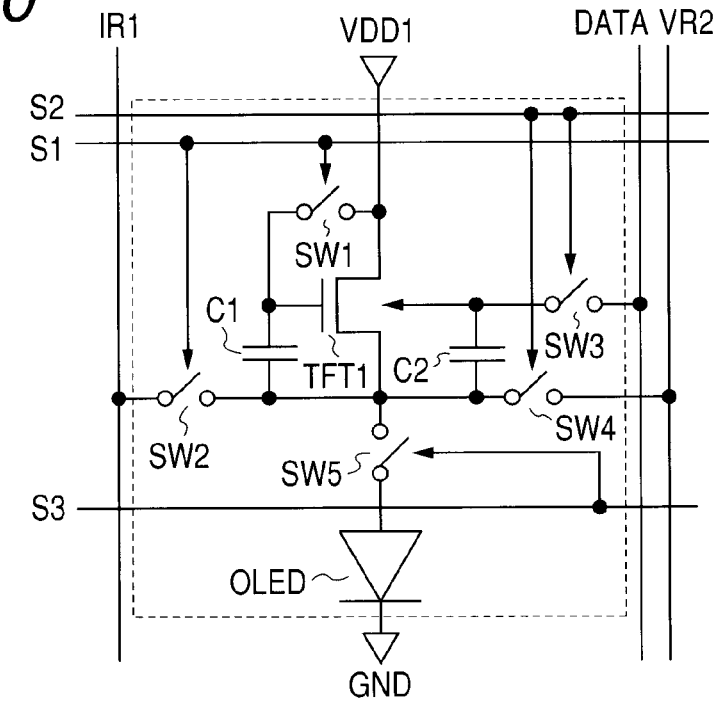
FIG. 10 is a circuit configuration diagram of a pixel circuit of embodiment 4 according to the present invention.

A pixel circuit of an OLED display of embodiment 4 is illustrated in FIG. 10. The characteristic of the present embodiment is that the current which is supplied from outside the pixel circuit and written is set as a constant current, and control of the luminance gray scale of the OLED element is performed with the voltage which is applied to the back gate from outside the pixel circuit.

The present embodiment adopts the same configuration as the circuit described in embodiment 3. However, the present embodiment differs from embodiment 3 in the point that the data line which supplies the IDATA in embodiment 3 is replaced with a reference current line IR1, and the reference voltage line VR1 which supplies the back gate voltage is replaced with a data line DATA.

Figure 11:
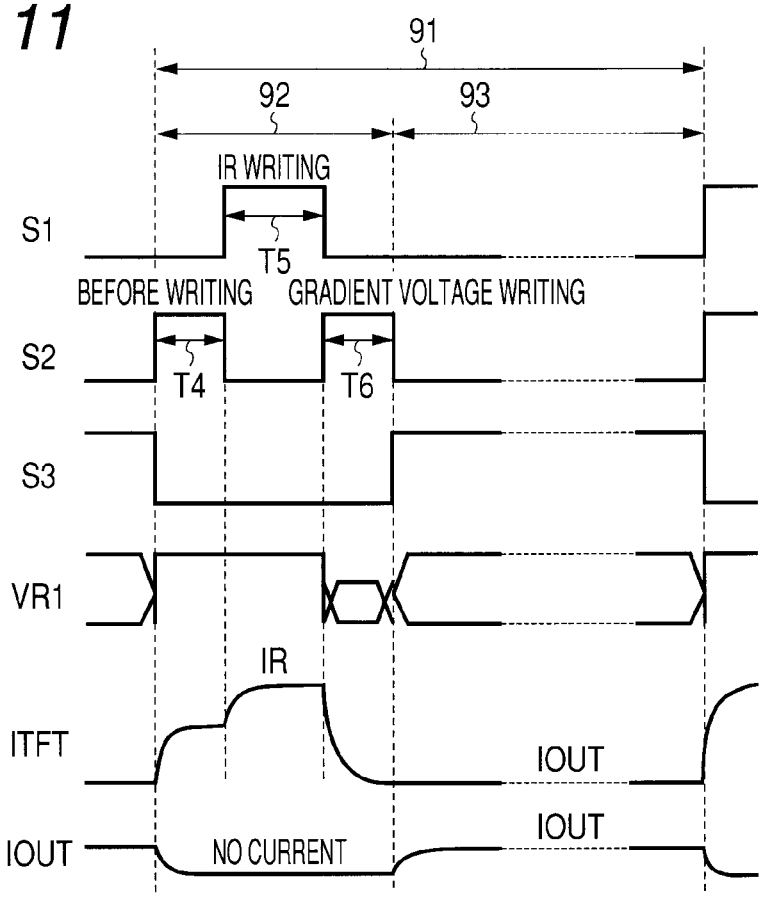
FIG. 11 is a timing chart illustrating an operation of the pixel circuit of embodiment 4.

A timing chart of the present embodiment is illustrated in FIG. 11, and an operation of it will be described hereinafter.

(1) Current Setting Period 92

In the present embodiment, two periods that are a back gate voltage writing period and a gray scale voltage writing period for controlling the back gate voltage are included before and after the current writing period, and in these three periods, the current which is supplied to the OLED element is set.

(a-1) Back Gate Voltage Writing Period T4

In a back gate voltage writing period T4, the voltage between the back gate and source in the current writing period is set.

In the back gate voltage writing period T4, the voltage of the scanning line S2 is set at an H level (VH'), and the voltages of the scanning lines S1 and S3 are set at an L level (VL'). Accordingly, the switches SW3 and SW4 are in an ON state, whereas the switches SW1, SW2 and SW5 are in an OFF state.

In the above case, when the voltage of the data line DATA is set at the H level (VH), and the voltage of the reference voltage line VR2 is set at 0 V, the voltage VH is applied to the capacitor C2.

(a-2) Current Writing Period T5

In a current writing period T5, the current IR which is supplied from outside the pixel circuit through the current reference line IR1 is written to the TFT 1.

In the current writing period T5, the voltage of the scanning line S1 is set at the H level (VH'), and the voltages of the scanning lines S2 and S3 are set at the L level (VL'). Accordingly, the switches SW1 and SW2 are in an ON state, and the switches SW3, SW4 and SW5 are in an OFF state. At this time, the voltage difference VH between the back gate and source which is set in the back gate voltage writing period is held by the capacitor C2.

The current IR flows in the TFT 1 without flowing in the OLED element since the switch SW5 is OFF. The gate voltage of the TFT 1 is set at the voltage for passing the current IR according to the current-voltage characteristics of the TFT 1, that is, the threshold voltage and mobility. The drain and gate of the TFT 1 is short-circuited, and therefore, the TFT 1 operates in the saturation region. Accordingly, the IR is expressed by the following formula.

$$IR=0.5\times\beta\times[(VG-VS)-\{VTH0-a\times VH\}]^2 \quad \text{formula (4'')}$$

(a-3) Gray Scale Voltage Writing Period T6

In the gray scale voltage writing period T6, the voltage corresponding to the gray scale is set to the back gate electrode of the TFT 1.

In the gray scale voltage writing period T6, the voltage of the scanning line S2 is set at the H level (VH'), and the voltages of the scanning lines S1 and S3 are set at the L level (VL'). Accordingly, the switches SW3 and SW4 are in an ON state, and the switches SW1, SW2 and SW5 are in an OFF state. Further, the voltage of the data line DATA is set as VDATA, and the voltage of the reference voltage line VR2 is kept at 0 V.

At this time, while the voltage difference between the gate and source of the TFT1 at the current writing time is being held, the voltage difference between the back gate and source becomes VDATA.

(b) Driving Period

In a driving period 93, the OLED element is driven by supplying to the OLED element the current which is controlled based on the back gate voltage VDATA supplied from the data line DATA.

In this period, the voltage of the scanning line S3 is set at the H level (VH'), and the voltages of the scanning lines S1 and S2 are set at the L level (VL'). Accordingly, the switch SW5 is in an ON state, and the switches SW1, SW2, SW3 and SW4 are in an OFF state. At this time, the voltage difference VDATA between the back gate and source is held by the capacitor C2.

By the operation in the above described current setting period 92, the current IOUT in this driving period 93 is expressed as $$IOUT=0.5\times\beta\times[(VG-VS)-\{VTH0-a\times VDATA\}]^2=[(IR)^{1/2}-a\times(0.5\times\beta)^{1/2}\times(VH-VDATA)]^2 \quad \text{formula (5")}.$$

In the present embodiment, as in embodiment 3, by using the capacitor C2, the switches SW3 and SW4, the data line DATA and the reference voltage line VR2, the voltage difference between the back gate and source is determined. Accordingly, in the lower stage of formula (5"), the equal sign (=) is used instead of the approximation sign.

Further, control of the luminance of the OLED element corresponding to the display gray scale of one frame period 91, that is, control of the current which is supplied to the OLED element can be performed by controlling the VDATA. The average current in one frame period which is supplied to the OLED element that determines luminance is expressed by the formula (7) since a current is not supplied to the OLED element at the current writing time. However, in the present embodiment, t1 is set as the length (time) of the current setting period instead of the current writing period. The IOUT also can be controlled by the current setting time, and further by the values of VH, VDATA and "a" in formula (5").

By carrying out the above operation, the AM type OLED display including the pixel circuits of the present embodiment in the matrix form can correct change and variation of the characteristics (threshold voltage, mobility) of the a-IGZO TFT, and can perform display with high quality. Further, the present embodiment holds the voltage between the back gate and source, and therefore, can correct not only the change and variation of the characteristics of the TFT, but also change and variation of the characteristics of the OLED elements.

Further, the present embodiment performs control of the IOUT by the voltage VDATA which is applied to the back gate voltage after the written constant current IR is set as the reference current. When a constant current is written, charge and discharge of the line load of the display is charge and discharge necessary for correcting the difference of the characteristics of the TFTs 1 of the respective pixel circuits. The charge and discharge is 1 V or less when expressed in voltage, and is from ten percent to several tens percent as compared with the voltage of several V for charge and discharge when writing the current for controlling the gray scale in embodiments 1 to 3. Accordingly, the period required for writing the current in the present embodiment is short. The period necessary for writing the voltage to the back gate electrode is also short since it is voltage writing. Therefore, the present embodiment is applicable to a large screen display.

Further, the present embodiment can hold the constant current IR for a long time by using the switches with a small leak current, and therefore, the back gate voltage writing period and the current writing period in the current setting period can be prepared separately from the gray scale voltage setting period and the driving period. For example, while in an OLED display, 60 frames are usually in one second, 61 frames are in one second. One frame is used for only the back gate writing period and the current writing period, and the other 60 frames can be configured by the gray scale voltage setting period and the driving period.

The off leak current is very small in the a-IGZO TFT, and therefore when used as the switch of the present embodiment, the aforementioned drive is enabled.

As the modified examples of the present embodiment, several pixel circuits can be used.

For example, in the present embodiment, the reference voltage line VR2 is separately prepared for setting the back gate voltage, but it can be replaced by the scanning line S3 with a constant voltage in the current setting period.

Figure 12:
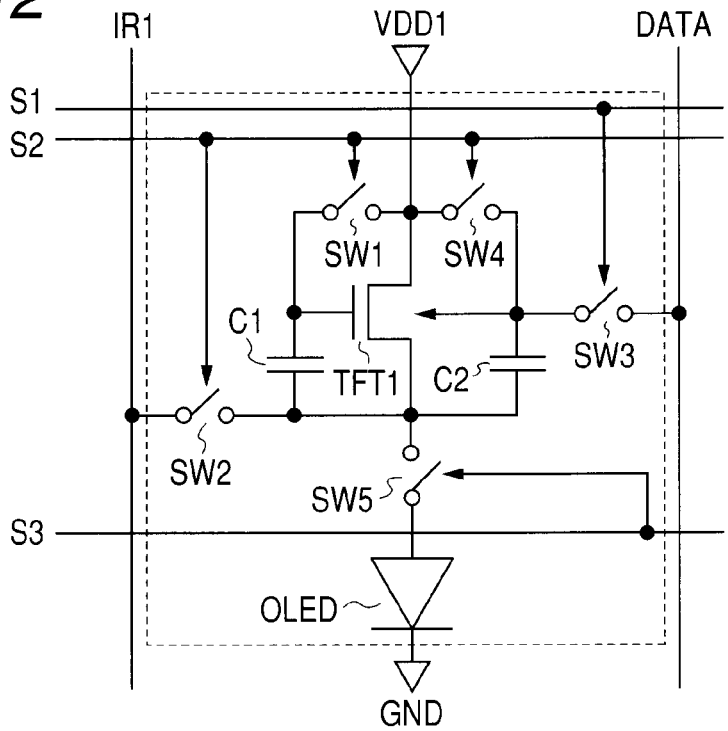
FIG. 12 is a circuit configuration diagram illustrating a modified example of the pixel circuit of embodiment 4.

As another modified example which does not use the VR2, a pixel circuit in which the switch SW4 is arranged between the back gate and drain of the TFT 1 as illustrated in FIG. 12 is conceivable. However, in order to fix the source voltage of the TFT 1 in the gray scale voltage setting period, the voltage of the power supply line VDD1 in this period is set at 0 V. Thereby, in this derived type, the current IOUT which is supplied to the OLED element is expressed by formula (5"). However, in this derived type, the voltage difference between the back gate and source in the current writing period is VG-VS which is the same as the voltage difference between the gate and source.

Though in the present embodiment, the scanning line S3 and the switch SW5 are included for the current writing period, but as still another modified example, they can be omitted by driving the pixel circuit as in embodiment 2.

As above, the pixel circuit including the TFT having the back gate electrode of each of the embodiments has the unit that applies the voltage provided from outside the pixel circuit to the back gate electrode, and further has the period for writing the current supplied from outside the pixel circuit. Further, the pixel circuit of each of the embodiments controls the voltage of the back gate electrode of the aforementioned thin film transistor in the two periods that are the period for writing a current and the driving period for supplying the controlled current to the light emitting element. By using these pixel circuits in the light emitting display device, the light emitting display device with a large line load can be driven.

The OLED display having the pixel circuit of each of the aforementioned embodiments can configure the information processing apparatus. The information processing apparatus is a cellular phone, a portable computer, a still camera, an image camera or an apparatus which realizes a plurality of these functions. The information processing apparatus includes an information input unit. For example, in the case of a cellular phone, the information input unit is configured by including an antenna. In the case of a PDA or a portable personal computer, the information input unit is configured by including an interface unit for a network. In the case of a still camera and a movie camera, the information input unit is configured by including a sensor unit (image taking unit) by a CCD and a CMOS.

As a preferred embodiment of the present invention, a digital camera using an AM type OLED display having the pixel circuit of each of the aforementioned embodiments will be described hereinafter.

Figure 14:
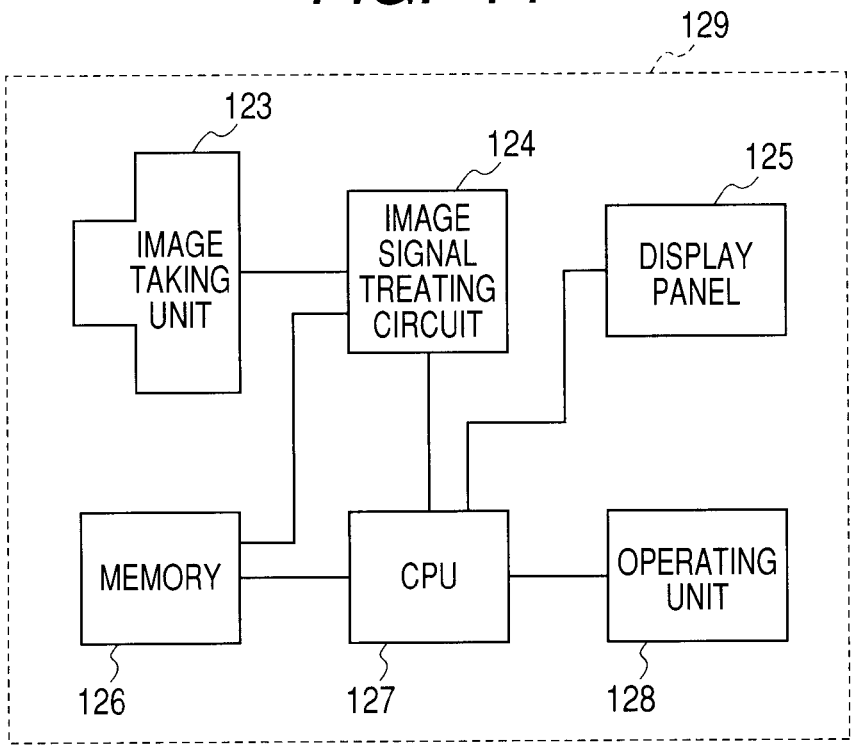
FIG. 14 is a block diagram illustrating a configuration of a digital camera using an AM type OLED display.

FIG. 14 is a block diagram of one example of a digital still camera. FIG. 14 illustrates an entire system 129, an image taking unit 123 that takes an image of a subject, an image signal processing circuit 124 (to be an image signal processing unit), a display panel 125, a memory 126, a CPU 127, and an operating unit 128. An image taken by the image taking unit 123, or the image recorded in the memory 126 is subjected to signal processing in the image signal processing circuit 124, and can seen on the display panel 125 to be a light emitting display device. In the CPU 127, by input from the operating unit 128, the image taking unit 123, the memory 126, the image signal processing circuit 124 and the like are controlled, and image taking, recording, reproducing and display suitable for the situation are performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-226061, filed Sep. 3, 2008, which is hereby incorporated by reference herein in its entirety.

What is claimed is:

1. A pixel circuit comprising:

a light-emitting element; and a drive thin film transistor (TFT) that supplies to the light-emitting element a first current controlling a gray scale according to luminance-current characteristics of the light-emitting element, wherein the drive TFT includes a semiconductor layer constituted by a channel region, a source region and a drain region, a gate electrode located at a top side or a bottom side of the semiconductor layer, and a back gate electrode disposed in an opposite side of the semiconductor layer to the gate electrode, wherein the drive TFT operates in a writing period so that a voltage is written between the gate electrode and the source region of the drive TFT by a second current flowing in the drive TFT and in a driving period so that the first current is supplied to the light-emitting element according to the voltage between the gate electrode and the source region of the drive TFT, and wherein different voltage levels are applied to the back gate electrode in the writing period and in the driving period so that a threshold voltage of the drive TFT in the driving period is higher than in the writing period, and thereby the second current is larger than the first current.

2. The pixel circuit according to claim 1, wherein a change in mobility of the drive TFT by variation of the voltage to be applied to the back gate electrode is 5% or less.

3. The pixel circuit according to claim 2, wherein a relationship between the voltage to be applied to the back gate electrode and the threshold voltage of the drive TFT is expressed by a linear relation.

4. The pixel circuit according to claim 1, wherein the second current is supplied from outside of the pixel circuit in the writing period.

5. The pixel circuit according to claim 1, wherein the voltage provided to the back gate electrode in the writing period controls the gray scale.

6. The pixel circuit according to claim 1, wherein the pixel circuit is one of a plurality of pixel circuits arranged two-dimensionally, and wherein the pixel circuit is incorporated in a light-emitting display device that includes a scanning unit for applying the voltage to back gate electrodes of plural pixel circuits arranged in a row direction for each row.

7. The pixel circuit according to claim 6, wherein the light-emitting device is incorporated in a camera that includes:

an image taking unit for taking an image of a subject; and an image signal processing unit for processing a signal of an image taken in the image taking unit, wherein an image signal subjected to signal processing in the image signal processing unit is displayed in the light-emitting display device.

8. A driving method of a pixel circuit that includes a light-emitting element and a drive thin film transistor (TFT) that supplies to the light-emitting element a first current controlling a gray scale according to luminance-current characteristics of the light-emitting element, wherein the drive TFT includes a semiconductor layer constituted by a channel region, a source region, and a drain region, a gate electrode located at a top side or a bottom side of the semiconductor layer, and a back gate electrode disposed in an opposite side of the semiconductor layer to the gate electrode, the method comprising:

writing a voltage between the gate electrode and the source region of the drive TFT by flowing a second current to the drive TFT during a writing period, the drive TFT supplying the first current to the light-emitting element according to the voltage between the gate electrode and the source region of the drive TFT during a driving period, and applying different voltage levels to the back gate electrode during the writing period and during the driving period so that a threshold voltage of the drive TFT in the driving period is higher than that in the writing period, and thereby the second current is larger than the first current.

9. The driving method of a pixel circuit according to claim 8, wherein the second current supplied from outside of the pixel circuit in the writing period controls the gray scale.

10. The driving method of a pixel circuit according to claim 8, wherein the voltage provided to the back gate electrode in the writing period controls the gray scale.

11. The driving method according to claim 8, wherein the pixel circuit is one of a plurality of pixel circuits arranged two-dimensionally in a light-emitting display device, and wherein the different voltage levels are provided to back gate electrodes of plural pixel circuits arranged in a row direction for each row.

* * * * *